US009735457B2

(12) United States Patent
Heid et al.

(10) Patent No.: US 9,735,457 B2
(45) Date of Patent: Aug. 15, 2017

(54) RF POWER COMBINER FUNCTIONING AS HIGHER-ORDER HARMONICS FILTER

(71) Applicants: OOO SIEMENS, Moscow (RU); SIEMENS AKTIENGESELLSCHAFT, München (DE)

(72) Inventors: Oliver Heid, Erlangen (DE); Timothy Hughes, Wantage (GB); Stepan Polikhov, Ramenskoye (RU); Alexander Smirnov, Moscow (RU)

(73) Assignees: OOO SIEMENS (RU); SIEMENS AKTIENGESELLSCHAFT (DE)

( * ) Notice: Subject to any disclaimer, the term of this patent is extended or adjusted under 35 U.S.C. 154(b) by 112 days.

(21) Appl. No.: 14/423,206

(22) PCT Filed: Feb. 18, 2013

(86) PCT No.: PCT/RU2013/000128

§ 371 (c)(1),
(2) Date: Feb. 23, 2015

(87) PCT Pub. No.: WO2014/035286

PCT Pub. Date: Mar. 6, 2014

(65) Prior Publication Data

US 2015/0255845 A1 Sep. 10, 2015

(30) Foreign Application Priority Data

Aug. 27, 2012 (WO) ..... PCT/RU2012/000699
Aug. 27, 2012 (WO) ..... PCT/RU2012/000702

(51) Int. Cl.
*H01Q 13/10* (2006.01)
*H01P 1/209* (2006.01)
(Continued)

(52) U.S. Cl.
CPC ..... *H01P 1/209* (2013.01); *H01P 3/06* (2013.01); *H01P 5/12* (2013.01); *H01Q 13/02* (2013.01);
(Continued)

(58) Field of Classification Search
USPC ..... 343/776, 767, 731
See application file for complete search history.

(56) References Cited

U.S. PATENT DOCUMENTS 2,501,105 A * 3/1950 Steinberger ..... H01Q 13/22 333/125
4,238,747 A 12/1980 Harp
(Continued)

FOREIGN PATENT DOCUMENTS

JP S59178801 A 10/1984
RU 2137264 C1 9/1999
WO WO 2013108674 A1 7/2013

OTHER PUBLICATIONS

Translation of Chinese Office Action for Chinese Application No. 201380049887.7, mailed on Jan. 21, 2016.
(Continued)

*Primary Examiner* — Hoang Nguyen
*Assistant Examiner* — Hai Tran
(74) *Attorney, Agent, or Firm* — Schmeiser Olsen & Watts LLP

(57) ABSTRACT

An RF power combiner functioning as a higher-order harmonics filter comprises: at least one pair of coaxially arranged disc-shaped metal conductors, at least one of the conductors having a central axial opening to accommodate a waveguide is provided. Facing surfaces of the disk-shaped metal conductors are shaped symmetrically with respect to the plane of symmetry of the disk-shaped metal conductors to form a plurality of consecutive, radially communicating concentric cavities having isosceles trapezoids with different bases in section. The smaller base of each trapezoid disposed closer to the central axis. The number of the concentric cavities is (2 k+1), where K is the number of signal harmonics being filtered.

18 Claims, 8 Drawing Sheets

(51) Int. Cl.

| | |
|---|---|
| ***H01P 5/12*** | (2006.01) |
| ***H01P 3/06*** | (2006.01) |
| ***H01Q 13/02*** | (2006.01) |
| ***H01Q 21/00*** | (2006.01) |
| *H01P 1/162* | (2006.01) |
| *H01P 1/212* | (2006.01) |

(52) U.S. Cl.
CPC ..... *H01Q 21/0012* (2013.01); *H01P 1/162* (2013.01); *H01P 1/212* (2013.01)

(56) References Cited

U.S. PATENT DOCUMENTS

| | | | | |
|---|---|---|---|---|
| 4,562,409 | A | 12/1985 | Kaneko | |
| 4,926,145 | A | 5/1990 | Flam | |
| 4,956,614 | A | 9/1990 | Baril | |
| 5,608,415 | A * | 3/1997 | Sugawara | H01P 1/202 333/202 |
| 6,242,984 | B1 | 6/2001 | Lee | |
| 6,545,644 | B1 * | 4/2003 | Sinclair | H01Q 13/12 343/767 |
| 7,385,462 | B1 | 6/2008 | Hoppe | |
| 2009/0303147 | A1 | 12/2009 | Choudhury | |
| 2011/0101893 | A1 * | 5/2011 | Heid | H05H 9/00 315/505 |
| 2012/0200458 | A1 | 8/2012 | Ames | |

OTHER PUBLICATIONS

Translation of Japanese Office Action for Japanese Application No. 2012P19452WOJP01, mailed on.

International Search Report for PCT Application No. PCT/RU2013/000128, mailed on Sep. 12, 2013, 3 pages.

Translation of Decision on Grant for Russian Application No. 2015110996, issued on Nov. 18, 2016.

Translation of Notice of Allowance for Japanese application No. 2015-529746, dated Aug. 19, 2016.

* cited by examiner

RF POWER COMBINER FUNCTIONING AS HIGHER-ORDER HARMONICS FILTER

CROSS-REFERENCE TO RELATED APPLICATIONS

This application claims priority to PCT Application No. PCT/RU2013/000128, having a filing date of Feb. 18, 2013, based off PCT Application No. PCT/RU2012/000702 and PCT Application No. PCT/RU2012/0699, both having a filing date of Aug. 27, 2012, the entire contents of which are hereby incorporated by reference.

FIELD OF TECHNOLOGY

The following relates to higher-order harmonics filter design, particularly, to an RF power combiner functioning as a higher-order harmonics filter.

BACKGROUND

The higher-order harmonic filters are needed for creation of class-F RF power amplifiers. These filters are required both to increase the efficiency of the amplifiers by reflecting the power carried by odd harmonics and to combine the power from several amplifiers (RF modules) and deliver it the load. The demand for such device is especially high for designing compact high-efficient RF generators/amplifiers.

Currently, there exist several patents concerning this problem: U.S. Pat. No. 4,562,409, U.S. Pat. No. 4,926,145, U.S. Pat. No. 6,242,984B1, U.S. Pat. No. 4,238,747 etc. All mentioned patents describe devices that solve the problem of parallel power combining with suppression of unwanted higher-order modes, propagating at frequencies higher than the operating one. The radial transmission line, to which the plurality of RF modules is connected, and output coaxial line is used in all patents.

U.S. Pat. No. 4,238,747 discloses a mode filter apparatus for preventing unwanted modes in a multi-moded structure utilizing a radial plurality of resonant slots on the bottom of the filter cavity. The top of the filter cavity includes a variable height center section to provide mode selectivity in cooperation with the resonant slots. The cylindrical resonant cavity has a radial pattern of resonant slots in the bottom plate and a variable height center portion in the top plate of the apparatus. The mode selectivity of the mode filter apparatus may be controlled by varying the height of the center portion of the top plate, as well as by changing the length, width and depth of the radial slots. The mode selectivity may also be varied by filling the radial slots with absorbing material to various depths.

U.S. Pat. No. 4,926,145 discloses a radial power combiner/divider in which energy corresponding to undesired higher order modes in the radial transmission line, including the m=1 and m=2 modes, is effectively absorbed. In said radial power combiner/divider radial slots are provided for suppression of undesired modes, certain undesired modes which are not adequately suppressed by the radial slots are allowed to be propagated in a central coaxial transmission line and suppressed therein by means of longitudinal slots in the outer conductor. In an alternative embodiment, the central transmission line of the combiner/divider is in the form of a circular waveguide, and the suppression means comprises thin, spaced coaxial cylinders of dissipative material.

U.S. Pat. No. 4,562,409 discloses a cavity resonator coupling-type power distributor/power combiner which can distribute or combine microwave electric power over a wide bandwidth with a small insertion loss. A cavity resonator coupling-type power distributor/power combiner includes a first cavity resonator operatively resonating with a cylindrical TO,n,O mode, and a plurality of second cavity resonators arranged on the periphery of the first cavity resonator and extending radially and symmetrically with respect to the first cavity resonator. The second cavity resonators each have the same shape and size so that magnetic-field coupling is established between the first cavity resonator and each of the second cavity resonators, for distributing or combining microwave power in a microwave amplifier.

In the cavity resonator the higher harmonics are suppressed with radial slits in conductors of the radial line and longitudinal slits in the outer conductor of the output coaxial line; all slits are filled with absorbing dissipative material. These patents solve the problem of power combining and signal filtration. In mentioned patents, the power of the higher harmonics either dissipates in combiner walls or in dielectric material, but is not reflected back to the RF modules as it is claimed in present embodiments of the invention disclosure.

U.S. Pat. No. 6,242,984 relates to solid state power amplifier (SSPA) modules that splits a signal into multiple parts, uses distributed amplifiers to amplify the parts, and recombines the amplified parts into a single output.

An SSPA module in accordance with the present embodiment of the invention comprises a signal input, and a radial splitter connected to the signal input comprising a plurality of radially extending splitter waveguides. The SSPA module also includes a signal output, and a radial combiner connected to the signal output comprising a plurality of radially extending combiner waveguides. Connections between the splitter and combiner are provided by a plurality of vertically extending waveguides. The SSPA module also includes a plurality of processing circuits for example MMIC amplifiers, connected to the combiner waveguides. A waveguide to microstrip transition may also be used to connect signals propagating in the waveguides to and from microstrip lines connected to the processing circuitry. Generally, the transition includes a waveguide section with a top conducting layer that defines a first slit and a second slit bounding a transition area abutting a microstrip section to form a waveguide to microstrip transition.

In patent U.S. Pat. No. 4,562,409 as in U.S. Pat. No. 6,242,984B1 the signal from each RF module is first injected to a cavity resonator based on rectangular waveguide, which is coupled via magnetic field to a radial line segment with coaxial output. That design implies two resonators in series, which is possible to use for the reflection of the third harmonic.

SUMMARY

Thus, filters are required both to increase the efficiency of the amplifiers by reflecting the power carried by odd harmonics and simultaneously to combine the power from several amplifiers (RF modules) and deliver it the load.

An aspect relates to providing a radial RF filter that serves the problem of increasing the efficiency of the amplifiers by reflecting the power carried by odd harmonics and simultaneously to combine the power from several amplifiers (RF modules) and deliver it a load.

A further aspect provides a RF power combiner functioning as a higher-order harmonics filter, comprising:

at least one pair of coaxially arranged disc-shaped metal conductors, at least one of said conductors having a central axial opening to accommodate a waveguide, wherein facing surfaces of the disk-shaped metal conductors are shaped symmetrically with respect to the plane of symmetry of the disk-shaped metal conductors to form a plurality of consecutive, radially communicating concentric cavities having isosceles trapezoids with different bases in section, with the smaller base of each trapezoid disposed closer to the central axis, wherein the number of the concentric cavities is (2 k+1), where K is the number of signal harmonics being filtered;

all concentric cavities of said plurality of cavities have the same radial length;

all concentric cavities of said plurality of cavities have a different angle at the trapezoid base, the angle being dependent on the wave impedance of a segment of a radial transmission line formed by each of the concentric cavities;

a plurality of horn antennae arranged uniformly around the periphery of the disc-shaped metal conductors and connected to the disk-shaped metal conductors, the radial length of a cavity of each horn antenna of said plurality being equal to the radial length of the concentric cavity, and the outer side of each horn antenna being adapted to connect an RF module, which is the source of RF signal and has an output in the form of a strip line;

the concentric cavities in the disc-shaped metal conductors and the cavities of the horn antennae form segments of radial non-dispersive transmission lines, in which electromagnetic T-wave propagates, the impedance magnitude of each of the segments having a constant value of line impedance in the cylindrical section parallel to the central axis, which is determined by the values of complex output impedances of the RF module on the analyzed harmonics.

According to one more aspect of embodiments of the invention, is provided an RF power combiner functioning as a higher-order harmonics filter, comprising:

at least one pair of coaxially arranged disc-shaped metal conductors, at least one of said conductors having a central axial opening to accommodate a waveguide, wherein facing surfaces of the disk-shaped metal conductors are shaped symmetrically with respect to the plane of symmetry of the disk-shaped metal conductors to form a plurality of consecutive, radially communicating concentric cavities having isosceles trapezoids with different bases in section, with the smaller base of each trapezoid disposed closer to the central axis, wherein the number of the concentric cavities is (2 k+1), where K is the number of signal harmonics being filtered;

all concentric cavities of said plurality of cavities have the same radial length;

all concentric cavities of said plurality of cavities have a different angle at the trapezoid base, the angle being dependent on the wave impedance of a segment of a radial transmission line formed by each of the concentric cavities;

a plurality of horn antennae made integrally with the disk-shaped metal conductors and arranged uniformly around the periphery of the disc-shaped metal conductors, the radial length of a cavity of each horn antenna of said plurality being equal to the radial length of the concentric cavity, and the outer side of each horn antenna being adapted to connect an RF module, which is the source of RF signal and has an output in the form of a strip line;

the concentric cavities in the disc-shaped metal conductors and the cavities of the horn antennae form segments of radial non-dispersive transmission lines, in which electromagnetic T-wave propagates, the impedance magnitude of each of the segments having a constant value of wave impedance in the cylindrical section parallel to the central axis, which is determined by the value of complex output resistance of the RF module on the analyzed harmonic.

Preferably the number of concentric cavities in said plurality of cavities is an odd number equal to at least three.

Preferably the disk-shaped metal conductors are made of copper.

Preferably the number of horn antennae is determined by the number of connected RF modules, each of the RF modules having an output power, and the total output power of the RF modules is the output power of the power combiner.

Preferably the second disc-shaped metal conductor comprises a unit for connecting an end of a waveguide.

Preferably, when connecting an end of a waveguide made in the form of a coaxial waveguide the outer conductor is connected to one of the disks, and the inner conductor is connected to the other disk.

Preferably, when connecting a waveguide to the power combiner both metal conductors are connected to the outer conductor of the coaxial waveguide.

Preferably, the RF power combiner comprises a housing in the form of a hollow cylinder to accommodate the disk-shaped metal conductors, said housing being arranged coaxially with the conductors and having a plurality of windows in the cylindrical side wall, equal to the number of horn antennae, to connect RF modules to the horn antennae, and a central opening in at least one end face to pass the coaxial waveguide.

Preferably, the RF power combiner comprises two or more pairs of coaxially arranged disc-shaped metal conductors.

The advantage obtained or the contribution to the claimed solution is unification of non-resonant power combiner and stepped-line filter based on radial transmission lines. The main advantages of the proposed embodiments of the invention are the following:

a) multiple devices based on the present embodiments of the invention can be easily integrated to a single power combiner design;

b) the odd harmonics are reflected back to the RF modules in order to achieve high efficient operation of solid state microwave amplifier;

c) the geometry of conducting walls of the radial filter with absence of resonating cavities yields low useful power dissipation.

BRIEF DESCRIPTION

Some of the embodiments will be described in detail, with reference to the following figures, wherein like designations denote like members, wherein.

DETAILED DESCRIPTION

Figure 1:
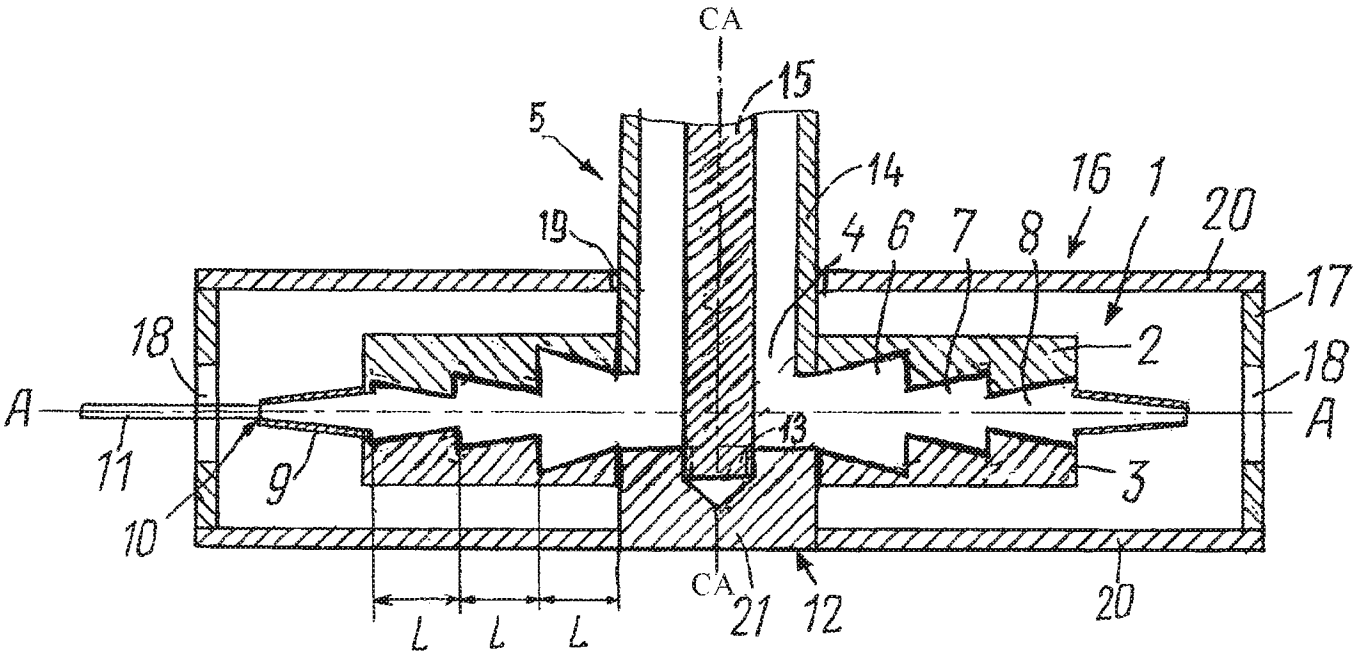
FIG. 1 depicts a schematic view of RF power combiner functioning as a higher-order harmonics filter, (longitudinal section)
Figure 2:
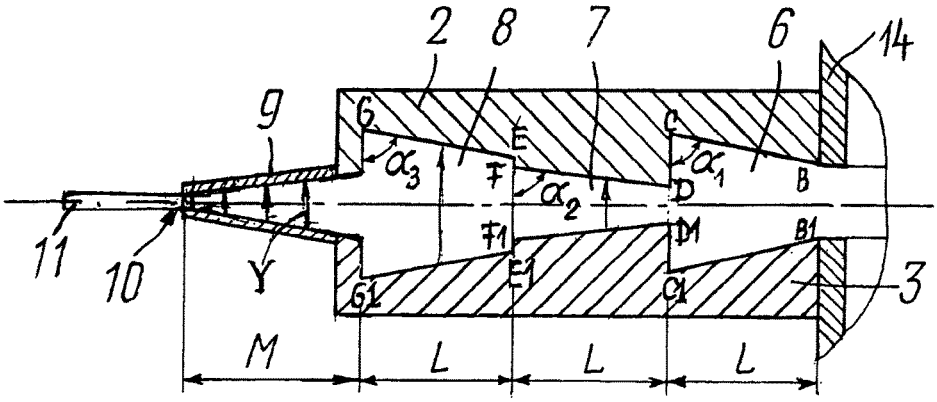
FIG. 2 depicts a schematic view of concentric cavities formed in the RF power combiner with the horn antennae.

The RF power combiner 1 (as shown in FIG. 1) functioning as a higher-order harmonics filter comprises at least one pair of coaxially arranged disc-shaped metal conductors 2, 3 located coaxially. At least one of said conductors 2 having a central axial opening 4 to accommodate a waveguide 5. Facing surfaces of the disk-shaped metal conductors 2, 3 are shaped symmetrically with respect to the plane of symmetry A-A of the disk-shaped metal conductors to form a plurality of consecutive, radially communicating concentric cavities 6, 7, 8 having isosceles trapezoids (as shown in FIG. 2) with different bases B-B1, C-C1, D-D1, E-E1, F-F1, G-G1 in section, with the smaller base B-B1, D-D1, F-F1 of each trapezoid disposed closer to the central axis CA.

The number of the concentric cavities is (2 k+1), where K is the number of signal harmonics being filtered. In FIG. 2 the device comprises three concentric cavities 6, 7, 8

All concentric cavities 6, 7, 8 of said plurality of cavities have the same radial length L and a different angle $\alpha 1$, $\alpha 2$, $\alpha 3$ at the trapezoid base, the angle being dependent on the wave impedance of a segment of a radial transmission line formed by each of the concentric cavities.

Figure 3:
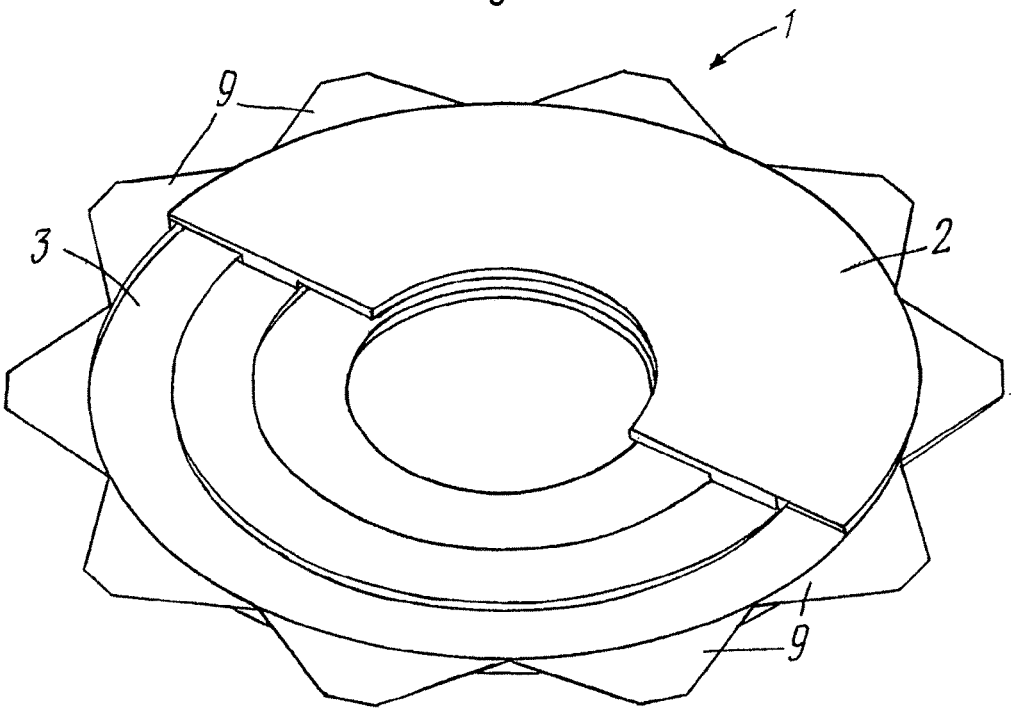
FIG. 3 depicts a perspective view of the disc-shaped metal conductors and the horn antennae (broken-out section view) formed integrally with the disc-shaped metal conductors.

The RF power combiner 1 (FIG. 1) comprises a plurality of horn antennae 9 (FIG. 3) arranged uniformly around the periphery of the disc-shaped metal conductors 2, 3 and connected to the disk-shaped metal conductors. The radial length M (abu.2) of a cavity of each horn antenna 9 of said plurality being equal to the radial length L of the concentric cavity, and the outer side 10 of each horn antenna 9 being adapted to connect an RF module, which is the source of RF signal and has an output in the form of a strip line.

The concentric cavities 6, 7, 8 in the disc-shaped metal conductors and the cavities of the horn antennae 9 form segments of radial non-dispersive transmission lines, in which electromagnetic T-wave propagates, the impedance magnitude of each of the segments having a constant value of line impedance in the cylindrical section parallel to the central axis, which is determined by the values of complex output impedances of the RF module on the analyzed harmonics. Arrow Y shows the direction of the electric field.

Figure 4:
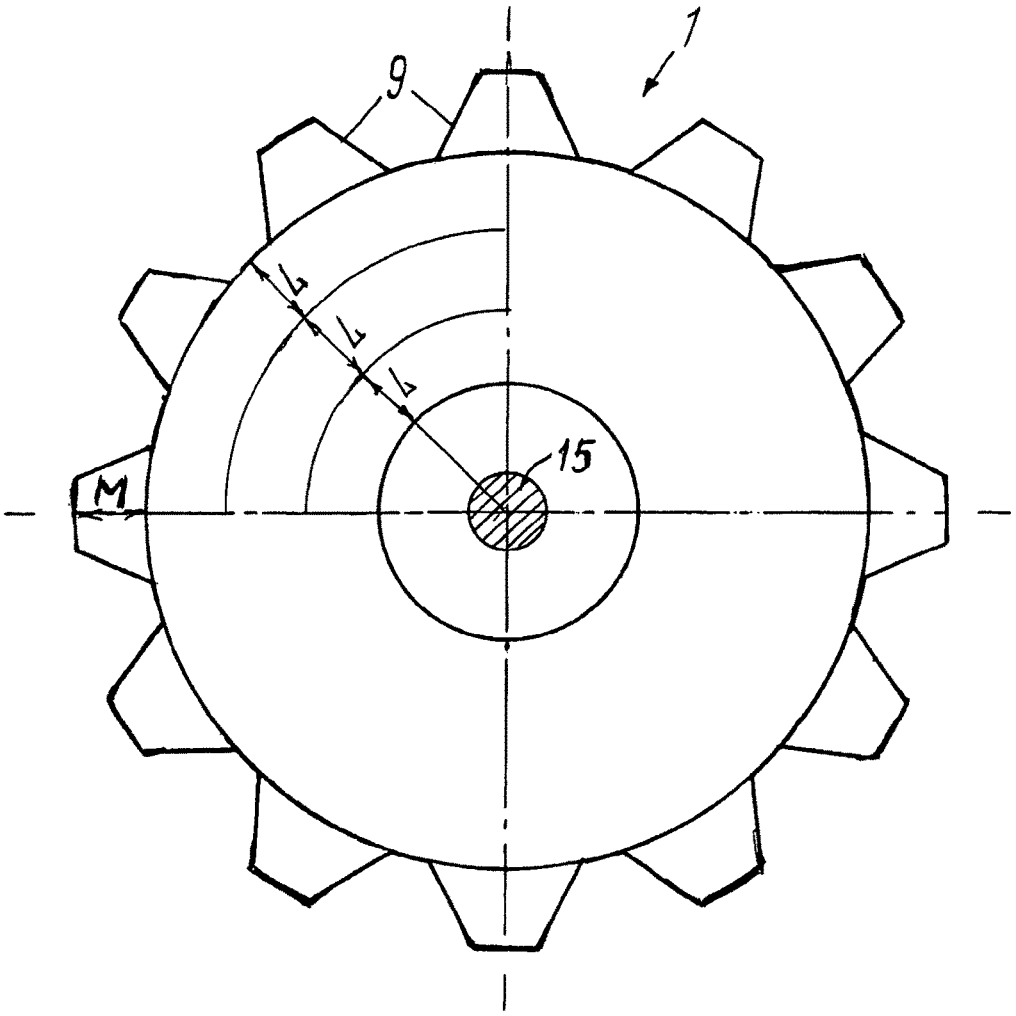
FIG. 4 depicts a top view of the disc-shaped metal conductors with the horn antennae.

According to the second aspect of the claimed embodiments of the invention the RF power combiner 1 functioning as a higher-order harmonics filter has the same construction as in the first embodiment but a plurality of horn antennae 9 are made integrally with the disk-shaped metal conductors and arranged uniformly around the periphery of the disc-shaped metal conductors (FIG. 4). Similarly to the first embodiment the radial length M of a cavity of each horn antenna of said plurality being equal to the radial length L of the concentric cavity, and the outer side of each horn antenna being adapted to connect an RF module, which is the source of RF signal and has an output in the form of a strip line.

The number of concentric cavities in said plurality of cavities is an odd number equal to at least three.

Preferably the disk-shaped metal conductors 2 and 3 are made of copper. Also it is possible to form from an alloy, for example, from aluminum with copper coating.

In general, the number of horn antennae 9 is determined by the number of connected RF modules 10, each of the RF modules having an output power, and the total output power of the RF modules 1 is the output power of the power combiner.

Figure 5:
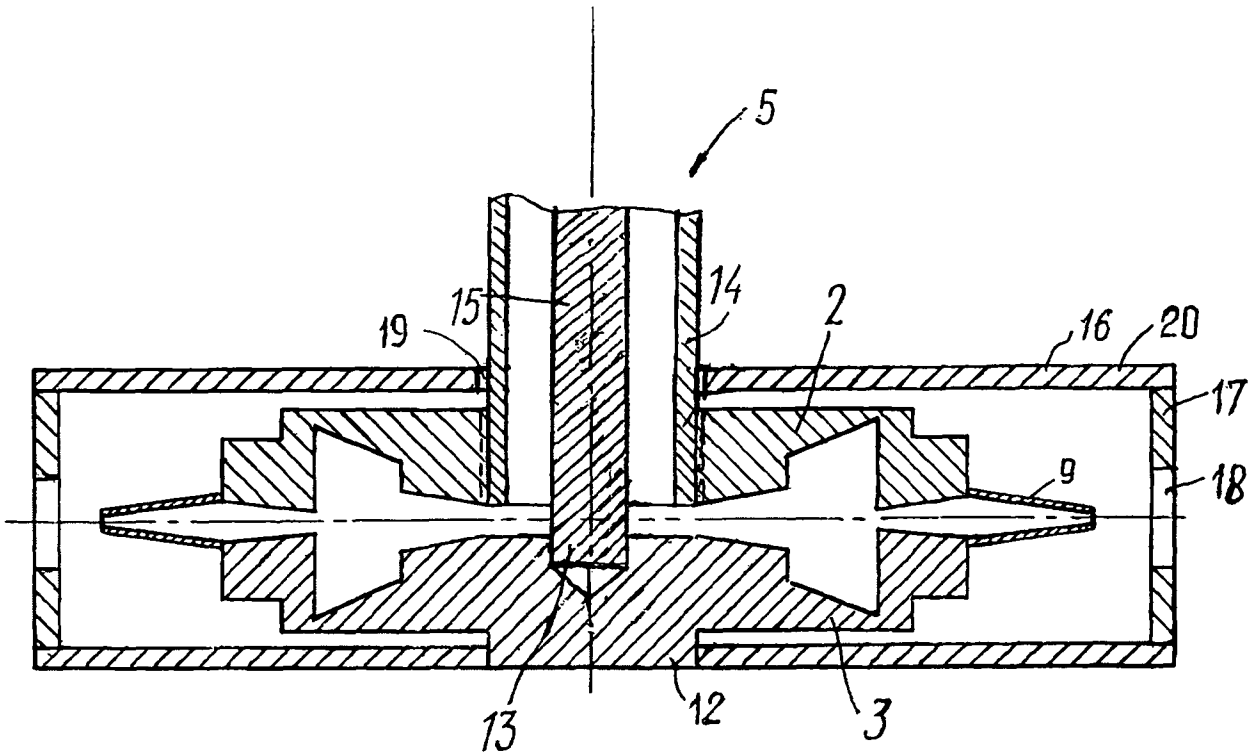
FIG. 5 depicts a schematic view of one more embodiment of the concentric cavities formed in the RF power combiner with the horn antennae (longitudinal section), the concentric cavities having shape that differs from FIG. 1.

Preferably, the second disc-shaped metal conductor 3 comprises a unit 12 (as shown in FIG. 1, FIG. 5) for connecting an end 13 of a waveguide 5.

Figure 6:
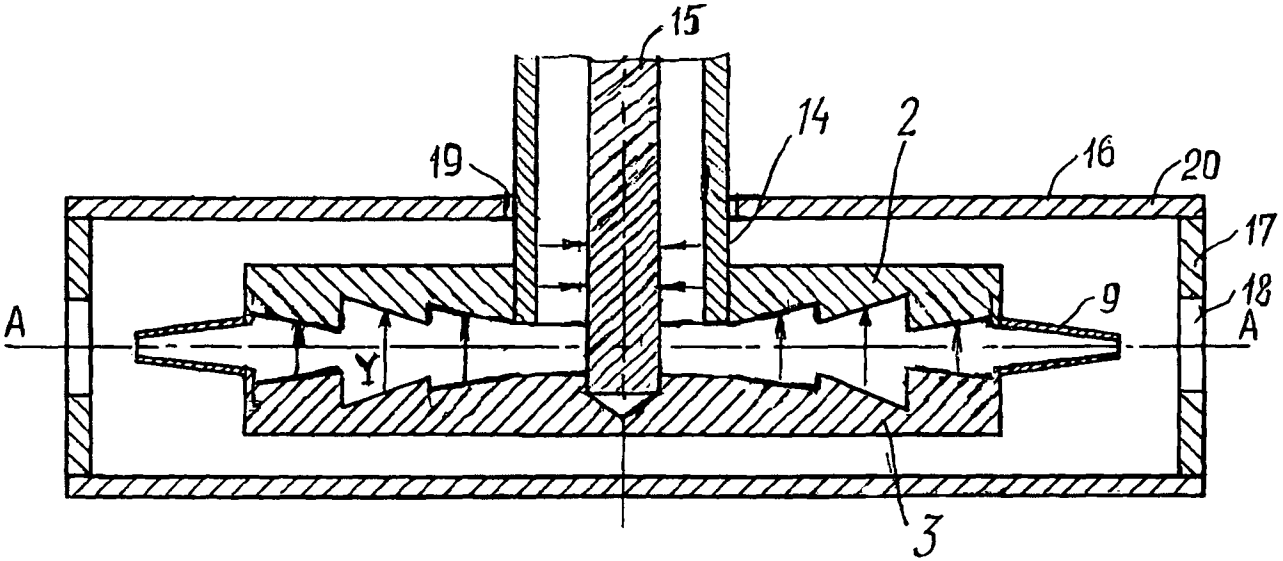
FIG. 6 depicts a schematic view of one more embodiment of the RF power combiner concentric cavities formed in the RF power combiner (longitudinal section), where the concentric cavities having shape that differs from FIG. 1 and wherein an outer conductor is connected to one of the disks and the inner conductor is connected to the other disk.

When connecting an end of a waveguide 5 made in the form of a coaxial waveguide (as shown in FIG. 5, FIG. 6) the outer conductor 14 is connected to one of the disks 2, and the inner conductor 15 is connected to the other disk 3.

In another embodiment when connecting a waveguide 5 to the power combiner both metal conductors 2, 3 are connected to the outer conductor 14 of the coaxial waveguide 5.

The RF power combiner further comprises a housing 16 (as shown in FIG. 1) in the form of a hollow cylinder to accommodate the disk-shaped metal conductors 2, 3. Said housing 16 being arranged coaxially with the conductors and has a plurality of windows 18 in the cylindrical side wall 17, the number of walls is equal to the number of horn antennae 9 such that to connect RF modules 11 to the horn antennae 9. Said housing 16 comprises and a central opening 19 in at least one end face 20 to pass the coaxial waveguide 5.

Figure 7:
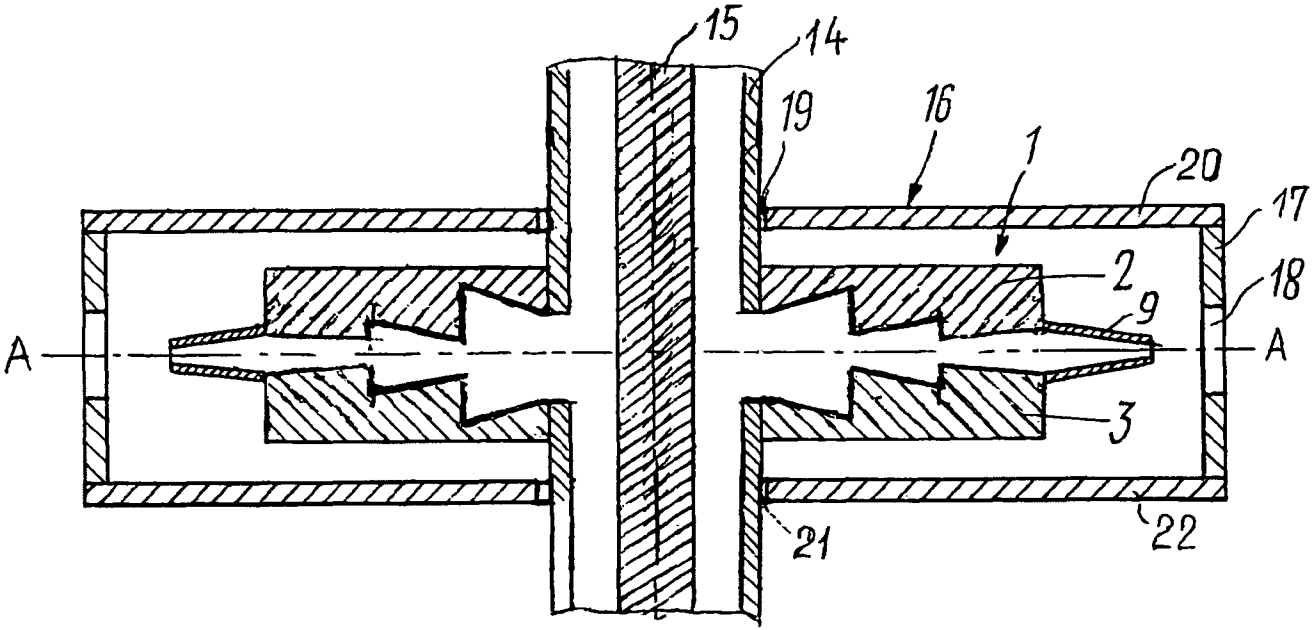
FIG. 7 depicts a schematic view of RF power combiner functioning as a higher-order harmonics filter, (longitudinal section) wherein the housing comprises two openings to pass the coaxial waveguide.

It is shown in FIG. 7 that said housing 16 comprises two central openings 19, 21 in both end faces 20, 22 correspondingly to pass the coaxial waveguide 5.

Figure 8:
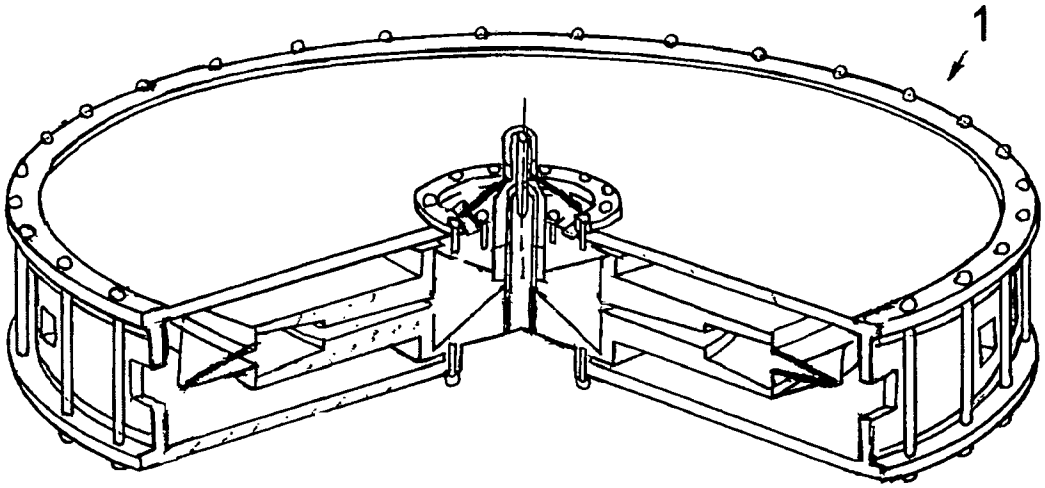
FIG. 8 depicts a perspective view the RF power combiner functioning as a higher-order harmonics.

FIG. 8 depicts a perspective view the RF power combiner 1 functioning as a higher-order harmonics.

Figure 9:
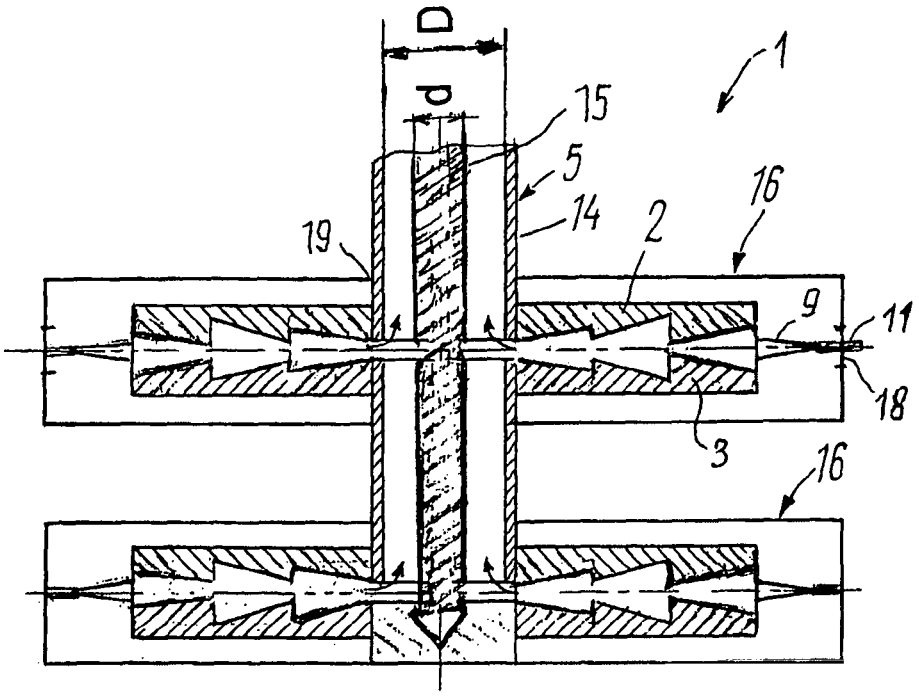
FIG. 9 depicts a schematic view of RF power combiner (longitudinal section) comprising two pairs of coaxially arranged disc-shaped metal conductors.

Preferably the RF power combiner 1 comprises two or more pairs of coaxially arranged disc-shaped metal conductors. It is shown in FIG. 9 that RF power combiner 1 comprises two pairs of coaxially arranged disc-shaped metal conductors.

The RF power combiner 1 functioning as a higher-order harmonics filter operates in the following way.

Fundamental harmonic is fed to the RF modules 11. Said RF modules 11 form the higher-order harmonics. All of the harmonics are fed to the RF power combiner 1.

Higher-order harmonics should be filtered.

During operation of the RF power combiner 1 functioning as a higher-order harmonics filter, the fundamental harmonic passes through all segments of the transmission lines formed by horn antennae and concentric cavities. The signals from all RF modules, consisting only of the fundamental harmonic, are summed and fed to the output coaxial waveguide.

The higher-order harmonics, the number of which is determined according to the total number of the segments of the transmission lines, formed by the horn antennae and the concentric cavities, are reflected "in phase" (the phase of the reflected wave is equal to the phase of the incident wave) and then are fed back to each RF module. Complex reflection coefficient is defined by the line impedances and lengths of the horn antennae and the line impedances and lengths of the concentric cavities excited on a wave of type TEM. The reflection of the signals on higher-order harmonies is necessary, particularly, since it allows class F operation of the RF modules.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

The invention claimed is:

1. An RF power combiner functioning as a higher-order harmonics filter, comprising:

at least one pair of coaxially arranged disc-shaped metal conductors, at least one of said conductors having a central axial opening to accommodate a waveguide, wherein facing surfaces of the disk-shaped metal conductors are shaped symmetrically with respect to a plane of symmetry of the disk-shaped metal conductors to form a plurality of consecutive, radially communicating concentric cavities having isosceles trapezoids with different bases in section, with a smaller base of each trapezoid disposed closer to a central axis of the concentric cavities, wherein the number of the concentric cavities is (2 k+1), where k is a number of signal harmonics being filtered;

all concentric cavities have a same radial length;

all concentric cavities have a different angle at the trapezoid base, the angle being dependent on a wave impedance of a segment of a radial transmission line formed by each of the concentric cavities;

a plurality of horn antennae arranged uniformly around the periphery of the disc-shaped metal conductors and connected to the disk-shaped metal conductors, the radial length of a cavity of each horn antenna of said plurality being equal to the radial length of the concentric cavity, and the outer side of each horn antenna being adapted to connect an RF module, which is a source of an RF signal and has an output in the form of a strip line;

the concentric cavities in the disc-shaped metal conductors and the cavities of the horn antennae form segments of radial non-dispersive transmission lines, in which electromagnetic T-wave propagates, an impedance magnitude of each of the segments having a constant value of line impedance in a cylindrical section parallel to the central axis of the concentric cavities, which is determined by the values of complex output impedances of the RF module on analyzed harmonics.

2. The RF power combiner according to claim 1, wherein the number of concentric cavities is an odd number equal to at least three.

3. The RF power combiner according to claim 1, wherein the disk-shaped metal conductors are made of copper.

4. The RF power combiner according to claim 1, wherein the number of horn antennae is determined by the number of connected RF modules, each of the RF modules having an output power, and the total output power of the RF modules is the output power of the power combiner.

5. The RF power combiner according to claim 1, wherein a second disc-shaped metal conductor comprises a unit for connecting an end of a waveguide.

6. The RF power combiner according to claim 1, wherein when connecting an end of a waveguide made in the form of a coaxial waveguide an outer conductor is connected to one of the disks, and an inner conductor is connected to the other disk.

7. The RF power combiner according to claim 1, wherein when connecting a waveguide to the power combiner both metal conductors are connected to the outer conductor of the coaxial waveguide.

8. The RF power combiner according to claim 1, comprising a housing in the form of a hollow cylinder to accommodate the disk-shaped metal conductors, said housing being arranged coaxially with the conductors and having a plurality of windows in the cylindrical side wall, equal to the number of horn antennae, to connect RF modules to the horn antennae, and a central opening in at least one end face to pass the coaxial waveguide.

9. The RF power combiner according to claim 1, comprising two or more pairs of coaxially arranged disc-shaped metal conductors.

10. An RF power combiner functioning as a higher-order harmonics filter, comprising:

at least one pair of coaxially arranged disc-shaped metal conductors, at least one of said conductors having a central axial opening to accommodate a waveguide, wherein facing surfaces of the disk-shaped metal conductors are shaped symmetrically with respect to a plane of symmetry of the disk-shaped metal conductors to form a plurality of consecutive, radially communicating concentric cavities having isosceles trapezoids with different bases in section, with a smaller base of each trapezoid disposed closer to a central axis of the concentric cavities, wherein the number of the concentric cavities is (2 k+1), where k is a number of signal harmonics being filtered;

all concentric cavities have the same radial length;

all concentric cavities have a different angle at each of the different bases, the angle being dependent on a wave impedance of a segment of a radial transmission line formed by each of the concentric cavities;

a plurality of horn antennae made integrally with the disk-shaped metal conductors and arranged uniformly around the periphery of the disc-shaped metal conductors, the radial length of a cavity of each horn antenna of said plurality being equal to the radial length of a concentric cavity, and the outer side of each horn antenna being adapted to connect an RF module, which is the source of RF signal and has an output in the form of a strip line;

the concentric cavities in the disc-shaped metal conductors and the cavities of the horn antennae form segments of radial non-dispersive transmission lines, in which electromagnetic T-wave propagates, an impedance magnitude of each of the segments having a constant value of wave impedance in a cylindrical section parallel to the central axis of the concentric cavities, which is determined by the value of complex output resistance of the RF module on the analyzed harmonic.

11. The RF power combiner according to claim 10, wherein the number of concentric cavities is an odd number equal to at least three.

12. The RF power combiner according to claim 10, wherein the disk-shaped metal conductors are made of copper.

13. The RF power combiner according to claim 10, wherein the number of horn antennae is determined by the number of connected RF modules, each of the RF modules having an output power, and the total output power of the RF modules is the output power of the power combiner.

14. The RF power combiner according to claim 10, wherein a second disc-shaped metal conductor comprises a unit for connecting an end of a waveguide.

15. The RF power combiner according to claim 10, wherein when connecting an end of a waveguide made in the form of a coaxial waveguide an outer conductor is connected to one of the disks, and an inner conductor is connected to the other disk.

16. The RF power combiner according to claim 10, wherein when connecting a waveguide to the power combiner both metal conductors are connected to the outer conductor of the coaxial waveguide.

17. The RF power combiner according to claim 10, comprising a housing in the form of a hollow cylinder to accommodate the disk-shaped metal conductors, said housing being arranged coaxially with the conductors and having a plurality of windows in the cylindrical side wall, equal to the number of horn antennae, to connect RF modules to the horn antennae, and a central opening in at least one end face to pass the coaxial waveguide.

18. The RF power combiner according to claim 10, comprising two or more pairs of coaxially arranged disc-shaped metal conductors.

* * * * *